US005588787A

United States Patent [19]

Manjunath et al.

[11] Patent Number: 5,588,787

[45] Date of Patent: Dec. 31, 1996

[54] PULSE-OPERATED POINT FEEDER

[75] Inventors: Konanur Manjunath, Porsgrunn; Knut A. Paulsen, Avaldsnes; Leiv B. Ognedal, Porsgrunn, all of Norway

[73] Assignee: Norsk Hydro a.s., Oslo, Norway

[21] Appl. No.: 493,534

[22] Filed: Jun. 22, 1995

[30] Foreign Application Priority Data

Jun. 22, 1994 [NO] Norway ..... 942371

[51] Int. Cl.[6] ..... B65G 53/20

[52] U.S. Cl. ..... 406/85; 406/89; 406/93; 406/194

[58] Field of Search ..... 406/85, 89, 90, 406/91, 93, 194

[56] References Cited

U.S. PATENT DOCUMENTS

| | | | |
|---|---|---|---|
| 490,584 | 1/1893 | McClave | 406/194 |
| 894,813 | 8/1908 | Buzzell et al. | 406/93 |
| 1,971,853 | 8/1934 | Ihlefeldt | 406/89 |
| 2,867,478 | 1/1959 | Shale | 406/85 |
| 4,185,942 | 1/1980 | Bazan | 406/85 |
| 4,451,184 | 5/1984 | Mitchell | 406/93 |

FOREIGN PATENT DOCUMENTS

| | | | |
|---|---|---|---|
| 1087426 | 2/1955 | France | 406/93 |
| 496640 | 4/1930 | Germany | 406/194 |

*Primary Examiner*—Gary C. Hoge
*Attorney, Agent, or Firm*—Wenderoth, Lind & Ponack

[57] ABSTRACT

A point feeder for metering powder materials, for example aluminum oxide, to a Hall-Heroult electrolysis cell includes a vertical tube and a horizontal tube which are joined so that they form substantially an L-shaped channel with a material input at an upper end of the vertical tube and a material output at an end of the horizontal tube. The vertical tube is provided with a nozzle device which has one or more downward-facing holes which allow air to penetrate in the form of pulsed air flows to the lower part of the vertical tube and to the whole of the horizontal tube.

7 Claims, 3 Drawing Sheets

Air pulse
Direction of air
1
2
3
4
5
6
7
8
9
10
11
12
13

PULSE-OPERATED POINT FEEDER

BACKGROUND OF THE INVENTION

The present invention relates to a point feeder or metering device for metering or dosing powder materials, for example, aluminum oxide (called oxide in the following), to a Hall-Heroult electrolysis cell. The point-feeder includes a vertical tube and a horizontal tube which are joined so that they basically form an L-shaped channel with material inflow at the upper end of the vertical tube and material outflow at the end of the horizontal tube.

Point feeders or metering devices and transport devices which use the fluidizing principle for metering and transporting powder materials have long been known. Furthermore, it is known that the principle is also used for separating a fluidizable material from a non-fluidizable material. When the fluidizing principle is used to transport oxide, for example, a gas (usually air) is added to the base of a longitudinal, slightly inclined channel in which the oxide is placed by means of the gravitational forces which arise when an oxide flow is released from an oxide feed silo located at a higher location. When the oxide has reached the transport channel and has air blown through it, the oxide is transformed from a sugar/flour-like material to a virtually liquid material in the direction of inclination of the channel and flows forwards along this channel without the use of mechanical transport devices such as belt. The fluidizing principle can be used for all powder materials which can be fluidized, i.e. powder materials which are not mixed with foreign bodies or contain large lumps. In warm regions, where the humidity is high, it is very difficult to get point feeders to work satisfactorily because the oxide easily forms or becomes packed, especially if the oxide contains a lot of fine materials (i.e. is flour-like in its consistency). One way of solving this problem is to add hot air to the oxide as the fluidizing medium in the transport channel, but here the system in itself can constitute a restricting factor.

Norwegian patent application No. 925027 describes a metering device in which the normal fluidizing principle is employed. The problem with such device is that it is not suitable, or not very suitable for use under humid climatic conditions or if the oxide has become damp for other reasons. It is important that a point feeder or a metering device be able to function under the majority of operating conditions.

SUMMARY OF THE INVENTION

The object of the present invention is to provide a point feeder or metering device which is operationally reliable even under difficult operating conditions, easy to operate and inexpensive to produce and maintain.

In accordance with the present invention, there is provided a metering device or point feeder which has in a vertical tube thereof a nozzle device, that preferably is arranged centrally within the vertical tube, that is connected to a gas or air source and that has one or more downward-facing holes that enable pulsed air flows to pass into the lower part of the vertical tube and the entire horizontal tube.

BRIEF DESCRIPTION OF THE INVENTION

The present invention will be described in more detail in the following with reference to the enclosed drawings, in which.

DETAILED DESCRIPTION OF THE INVENTION

Figures 1, 2:
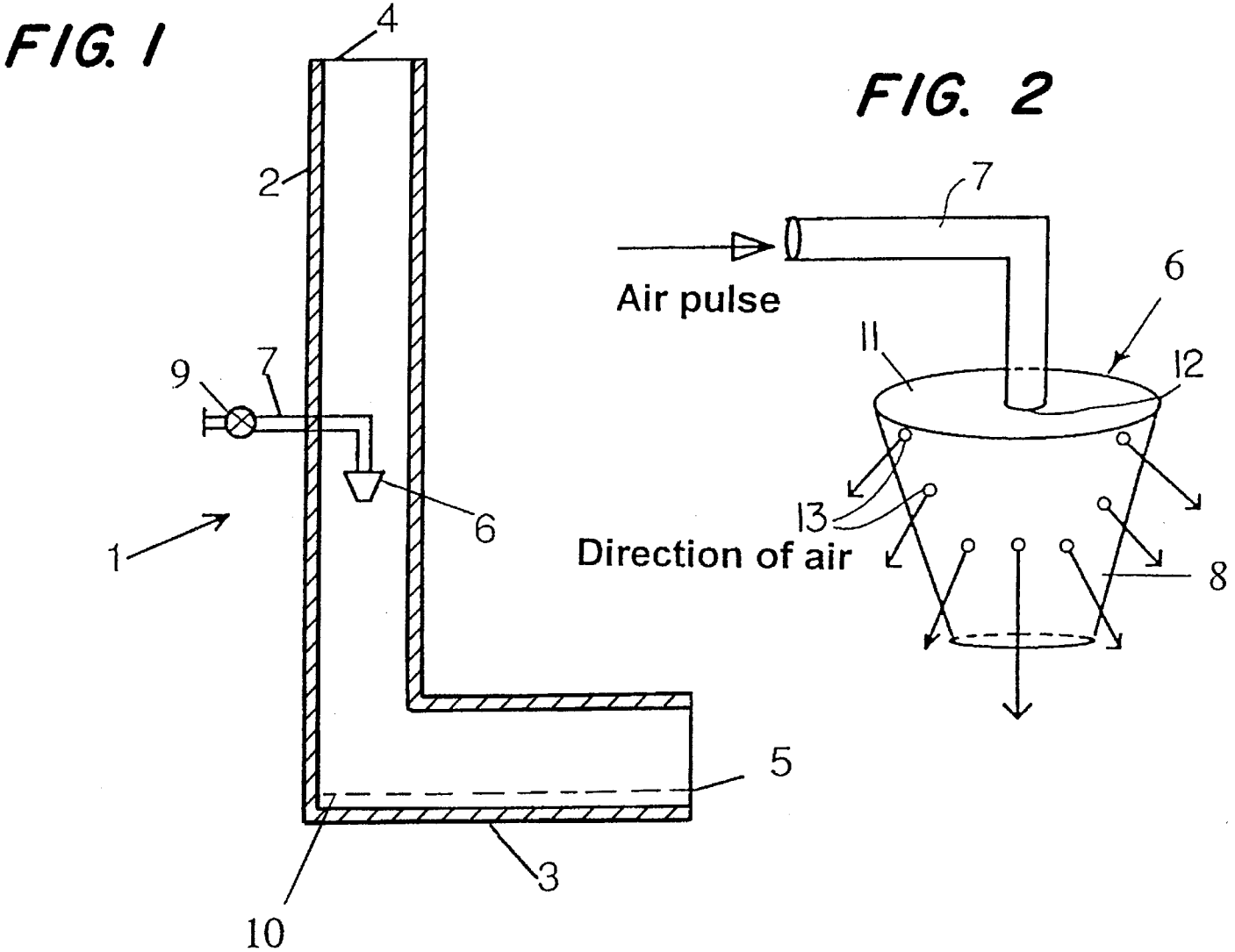
FIG. 1 is a schematic view of a metering device or a point feeder in accordance with the present invention.
FIG. 2 is a schematic view of an enlarged scale of a nozzle device employed in FIG. 1.

A metering device or point feeder in accordance with the present invention includes, as shown in FIG. 1, two tubes 2, 3 which are joined so that they form substantially an L-shaped channel with an inlet 4 and an outlet 5. The horizontal tube 3 can have a slightly inclined angle towards the outlet 5 and preferably is provided at the bottom thereof with a fluidizing device 10 in the form of a cloth or similar member. The vertical tube 2 is provided with a nozzle device 6, shown in larger scale in FIG. 2. Metering begins by an air pulse being released by a signal from a microprocessor to a valve 9 so that a supply of compressed air from a reservoir (not shown) passes via tube 7 to nozzle body 8 of device 6. The nozzle body 8 has a sealed upper end formed of a plate 11 that is wedded to body 8 and that is provided with a centrally located hole 18 into which the tube 7 passes and is fastened with a circumferential weld. Furthermore, the nozzle body 8 is shaped like a truncated cone and is made of thin plate material. Evenly distributed holes 13 are punched through the downward-facing surface of the body 8. Due to the downwardly diverging taper of body 8, air will discharge from body 8 in downwardly inclined flows into tube 2. In order that the metering of oxide to an electrolysis cell is even, the air pulses for all point feeders in an electrolysis cell are controlled by means of a microprocessor in such a way that the intervals and the flow of air to devices 6 to achieve metering of oxide are optimal over time. The nozzle body 8 is not restricted to the above-described arrangement. Thus, the nozzle can have just one or two holes instead of several, and the nozzle body may have different shapes, for example spherical or cylindrical.

Figure 3A:
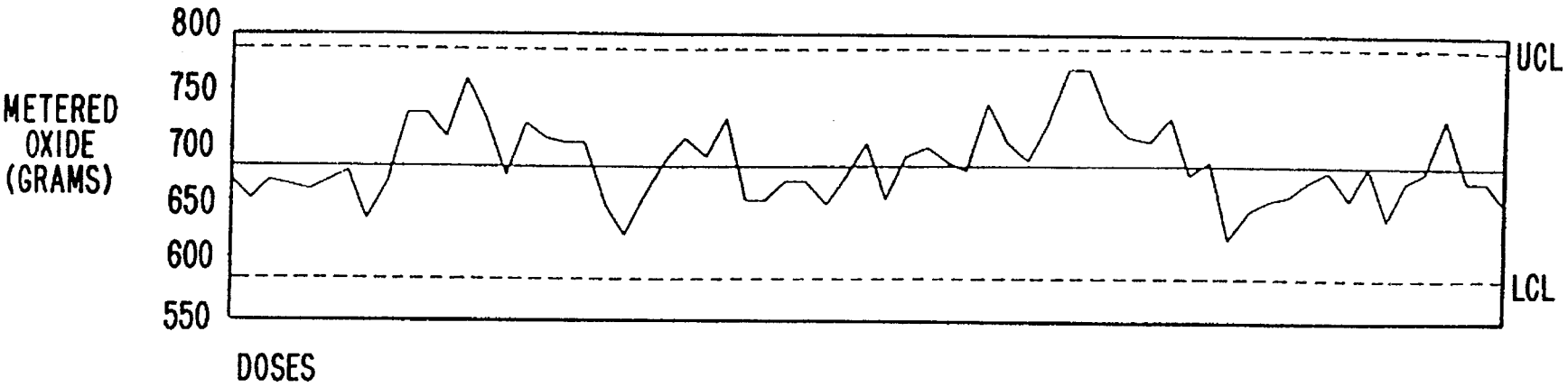
FIG. 3*a* and 3*b* are graphs illustrating performance capabilities of the point feeder.
Figure 3B:
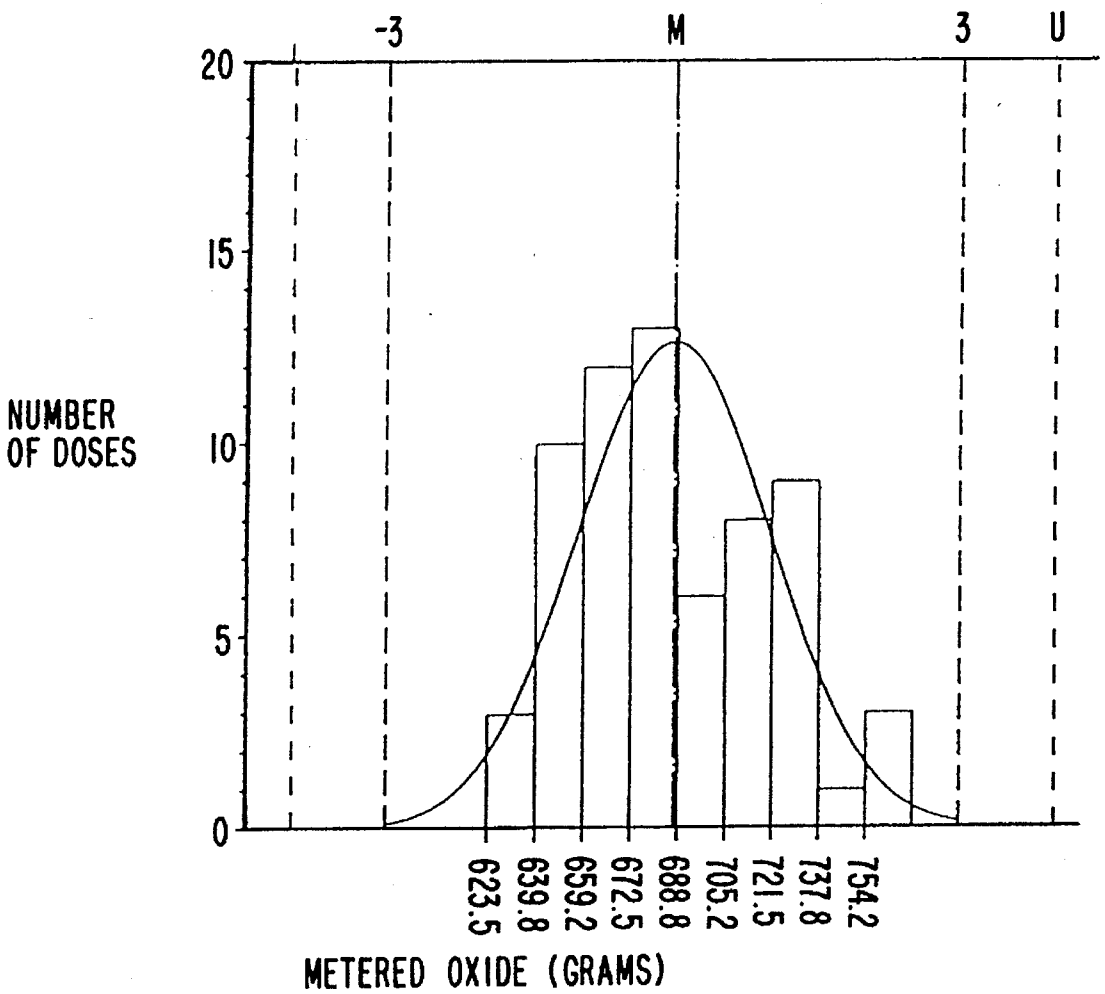

FIGS. 3*a* and 3*b* illustrate capabilities of the point feeder 1, i.e. its ability to produce a product to defined specifications with oxide being metering evenly over time in a required quantity. The capability of expressed by means of a capability index $C_{pk}$. An index of 1.0 is very good for this type of process. Data from experiments shown in FIGS. 3*a* and 3*b* were gathered with a point feeder prototype and with an oxide with very fine particles. This type of oxide is difficult to handle in production because the fine particles can easily cohere, i.e. bind together, which means that air must be used to obtain decohesion and a powder which flows easily. Experiments showed that the present invention has a capability of 1.33. Each intermittent air pulse had a duration of 5 seconds with an interval of 20 seconds between air pulses. Each air pulse produced a dose of 687.6 g of oxide on average. The standard deviation was 4.8%. With the present invention, a point feeder has been produced which is robust even for damp and fine-particle oxide. As FIGS. 3*a* and 3*b* show, the feed is even and well within the point feeder's own control limits (UCL, LCL), which are $\pm 3\sigma$.

We claim:

1. A metering device for metering accurate doses of powder material, said device comprising:

a vertical tube and a horizontal tube joined together to form an L-shaped channel, said vertical tube having an upper end defining an inlet for supply of powder material to said channel, and said horizontal tube having an end opposite said vertical tube and defining an outlet for discharge of metered doses of powder material from said channel;

a nozzle device mounted in said vertical tube and including at least one downwardly facing hole; and means for supplying intermittent gas pulses to said nozzle device resulting in at least one pulsed air flow from said at least one hole through a portion of said channel defined by a lower part of said vertical tube below said nozzle device and by the whole of said horizontal tube, and thereby for discharging from said outlet doses of powder material metered as a function of said pulses.

2. A metering device as claimed in claim 1, wherein said nozzle device is located centrally within said vertical tube.

3. A metering device as claimed in claim 1, wherein said nozzle device has plural said downwardly facing holes.

4. A metering device as claimed in claim 3, wherein said plural holes are distributed evenly of said nozzle device.

5. A metering device as claimed in claim 3, wherein said nozzle device comprises a body having a truncated downwardly converging conical wall, and said plural holes extend through said wall in downwardly inclined directions.

6. A metering device as claimed in claim 1, wherein said vertical and horizontal tubes extend relative to each other at an angle other than a right angle.

7. A metering device as claimed in claim 1, further comprising a fluidizing device in said horizontal tube.

* * * * *